US007759566B2

(12) United States Patent
Regh

(10) Patent No.: US 7,759,566 B2
(45) Date of Patent: Jul. 20, 2010

(54) TAILORING CRITICAL PROPERTIES OF WOOD-MASS, LATERAL AND TRANSVERSE STIFFNESS, AND DAMPING-FOR USE IN MUSICAL INSTRUMENTS

(76) Inventor: Joseph Regh, 36 Sherwood Heights, Wappingers Falls, NY (US) 12590

( * ) Notice: Subject to any disclaimer, the term of this patent is extended or adjusted under 35 U.S.C. 154(b) by 70 days.

(21) Appl. No.: 11/978,087

(22) Filed: Oct. 26, 2007

(65) Prior Publication Data

US 2009/0107318 A1 Apr. 30, 2009

(51) Int. Cl.
*G10D 3/00* (2006.01)

(52) U.S. Cl. ..... 84/291; 84/184

(58) Field of Classification Search ..... 84/184, 84/291

See application file for complete search history.

(56) References Cited

U.S. PATENT DOCUMENTS

| | | | | | |
|---|---|---|---|---|---|
| 127,383 | A * | 5/1872 | Steinway | 84/184 |
| 649,978 | A * | 5/1900 | Buyten | 451/31 |
| 989,510 | A * | 4/1911 | McCullough | 84/268 |
| 1,752,676 | A * | 4/1930 | Loitsch | 84/184 |
| 2,109,000 | A * | 2/1938 | Waldo, Jr. | 451/31 |
| 2,345,942 | A * | 4/1944 | Lehman | 428/170 |
| 2,488,068 | A * | 11/1949 | Roman | 451/38 |
| 3,704,531 | A * | 12/1972 | Seals | 434/84 |
| 4,031,798 | A * | 6/1977 | Sidner | 84/291 |
| 4,364,990 | A * | 12/1982 | Haines | 428/218 |
| 4,377,102 | A * | 3/1983 | Mayerjak | 84/184 |
| 4,916,995 | A * | 4/1990 | Soler et al. | 84/291 |
| 5,072,642 | A * | 12/1991 | Imagawa | 84/193 |
| 5,170,000 | A | 12/1992 | Hayashida et al. | |
| 5,969,301 | A * | 10/1999 | Cullum et al. | 181/286 |
| 6,639,135 | B1 * | 10/2003 | Lucas | 84/291 |
| 6,737,568 | B2 * | 5/2004 | Schleske | 84/291 |
| 7,141,730 | B1 * | 11/2006 | Wu | 84/291 |
| 7,201,193 | B1 * | 4/2007 | Skendzel | 144/358 |
| 7,314,071 | B2 * | 1/2008 | Park | 144/350 |
| 7,507,884 | B2 * | 3/2009 | Carlson | 84/192 |
| 2004/0154862 | A1 | 8/2004 | Carlson | |
| 2006/0288885 | A1 * | 12/2006 | Park | 100/234 |
| 2007/0044631 | A1 | 3/2007 | Fujii et al. | |
| 2009/0007752 | A1 * | 1/2009 | Kroeger et al. | 84/291 |

FOREIGN PATENT DOCUMENTS

WO PCT/US 08/11817 12/2008

* cited by examiner

*Primary Examiner*—Jeffrey Donels
*Assistant Examiner*—Robert W Horn
(74) *Attorney, Agent, or Firm*—Saile Ackerman LLC; Stephen B. Ackerman; Rosemary L. S. Pike

(57) ABSTRACT

Optimized tone wood for acoustical performance and methods for optimizing tone wood are described. The longitudinal to cross-grain stiffness ratio, the acoustical mass, and damping of tone wood are adjusted to improve volume and quality of tonal output. These properties are adjusted by selectively removing a portion of summer growth of the wood to reduce cross-grain stiffness while retaining the winter growth of the wood for longitudinal stiffness. Damping materials can modify the effects of the summer growth removal.

16 Claims, 6 Drawing Sheets

TAILORING CRITICAL PROPERTIES OF WOOD-MASS, LATERAL AND TRANSVERSE STIFFNESS, AND DAMPING-FOR USE IN MUSICAL INSTRUMENTS

BACKGROUND OF THE INVENTION (1) Field of the Invention

The invention relates to wood structures for musical instruments with improved sound, and processes for tailoring critical properties of wood for use in musical instruments, and more particularly, to processes for selective adjustments to along-grain and cross-grain stiffness, mass, and damping in wood for use in stringed instruments.

(2) Description of the Related Art

Spruce is the first choice for tone wood for musical instruments in the string family because of its mechanical and acoustical properties. The ratio of stiffness in the direction of the grain to the stiffness across the grain is one of the characteristics that make spruce desirable. Spruce exists naturally with a wide variation in the values of such properties as density, modulus of elasticity, damping, sound propagation velocity, grain spacing and grain distribution. Experienced luthiers know how to choose spruce to obtain the specific sound they aim for. This choice is made from, and is limited by, wood as it occurs in the natural state.

SUMMARY OF THE INVENTION

A principal object of the present invention is to provide a method of optimizing tone wood for acoustical performance by selectively thinning the wood.

Another object of the invention is to vary the cross-grain stiffness of tone wood by selectively removing summer growth between the winter growth ridges.

A further object is to adjust the longitudinal to cross-grain stiffness ratio, the acoustical mass, and damping of tone wood to improve volume and quality of tonal output.

A still further object is to provide tone wood for a musical instrument that is optimized for acoustical performance by having removed summer growth.

Yet another object is to provide an improved soundboard for a musical instrument that is optimized for acoustical performance by having strips of material raised above a substrate and spaced periodically along the long axis of the substrate.

In accordance with the objects of this invention optimizing tone wood for acoustical performance is achieved. The longitudinal to cross-grain stiffness ratio and the acoustical mass of tone wood are adjusted to improve volume and quality of tonal output. These properties are adjusted by selectively removing a portion of summer growth of the wood to reduce cross-grain stiffness while retaining the winter growth of the wood for longitudinal stiffness. Damping materials added in the removed areas can modify the effects of the summer growth removal.

Also in accordance with the objects of the invention, an optimized soundboard for use in stringed instruments is achieved. The soundboard comprises a substrate having strips of material raised above the substrate and spaced periodically along the long axis of the substrate wherein the longitudinal to cross-grain stiffness ratio of the substrate is increased by the strips of material. The substrate preferably is a spruce slab having a portion of its summer growth removed resulting in grooves formed in the summer growth wherein its winter growth is not removed and wherein the winter growth is raised above the remaining summer growth. Alternatively, the substrate can be wood, a thin wood veneer, or a plastic sheet where the strips of material comprise carbon fiber, wood, or light metal strips.

BRIEF DESCRIPTION OF THE DRAWINGS

In the accompanying drawings forming a material part of this description, there is shown.

DESCRIPTION OF THE PREFERRED EMBODIMENTS

Figure 1:
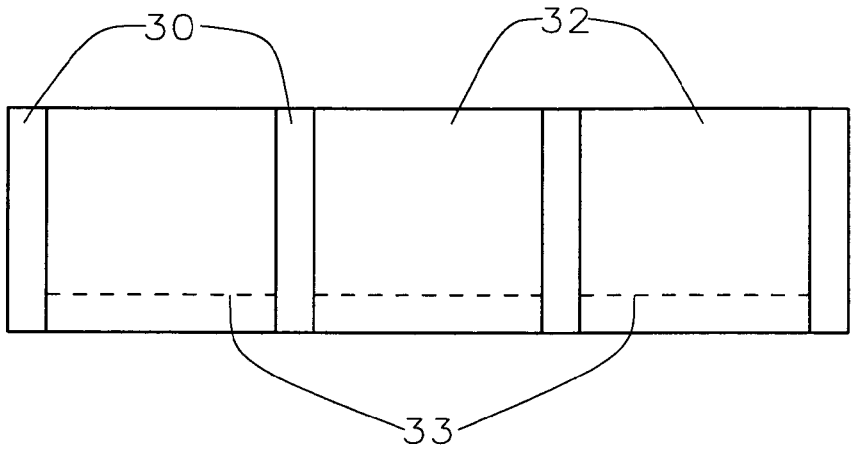
FIG. 1 schematically represents a cross-section of a piece of tone wood of the present invention.

Acoustical performance of stringed instruments is limited by the natural properties of the tone wood. The present invention allows the adjustment of the longitudinal to cross-grain stiffness ratio and the acoustical mass of the tone wood in order to improve volume and quality of tonal output.

Regraduation of instruments is a common way to improve acoustical properties. Removal of thin layers of wood is the presently used practice, but it reduces stiffness in all directions. Selective grooving will allow local reduction of mass and weakening of cross-grain thickness without affecting the longitudinal strength required to carry the load of the string tension.

The inventor observed that the application of commercial wood cleaners removed the softer summer growth preferentially over the harder winter growth. Longitudinal stiffness of wood is thought to be controlled by the narrow winter reeds acting like I-beams. Repeated applications removed significant amounts of soft pulp, leaving rails of the winter reeds protruding above the surface. Applying this observation to violin spruce, the inventor expected that intentional removal of some summer growth would weaken cross-grain stiffness by an amount proportional to the material removed. This technique would allow makers to tailor a piece of wood to attain the properties desired for instrument making. The removal of summer growth was expected to make a greater change in the cross-grain stiffness than in the longitudinal stiffness. Therefore the ratio of the two can be altered over a considerable range. The mass, controlled by density and thickness, can be changed independent of the stiffness ratio by starting with a thicker plate. The amount of pulp removed would reduce the mass and the depth of the groove would reduce cross-grain stiffness and increase the stiffness ratio.

Longitudinal (along grain) stiffness is primarily determined by the height and density or spacing of the winter reeds. When the summer growth has been removed or weakened, the remaining reed height controls the along-grain stiffness. Cross-grain or trans-grain stiffness is originally controlled by the material properties of the pulp (or summer growth) and its width and thickness. Altering the thickness of the pulp by selective removal or selective weakening radically affects the bending strength of the wood. Mass is controlled by the natural density and dimensions of the wood. It can be altered by removing pulp between the reeds. The material is removed from a shallow, wide section between the reeds so as not to have a large impact on stiffness.

The process of the present invention allows selective adjustments of the along-grain and cross-grain stiffness and mass of the tone wood, resulting in a soundboard of the invention for a musical instrument that has improved acoustical properties. The cross-grain stiffness of the wood, preferably spruce, is varied by selectively removing the soft summer growth between the hard winter growth ridges in quarter-sawn wood, while the along-grain stiffness is only slightly reduced. This effect can be produced by removing wood or by destroying cells by chemicals or radiation. The technique also lends itself to manipulate mass and stiffness independently. The overall mass that must be moved by acoustic energy imparted by the player comes from both the reedy winter growth and the summer pulp. If some pulp is removed, the mass is reduced. If a higher mass is desirable, perhaps locally, the plate could be started thicker and more pulp can be removed. The shape and depth of the groove can be varied to accomplish less stiffness by a deeper cut and less mass by a wider one or a combination of both. FIGS. 1-5 illustrate some of these possibilities.

FIG. 1 illustrates a schematic cross-section of a spruce slap. The narrow sections 30 represent winter growth, while the wide areas 32 represent summer growth. Spacing is variable in naturally occurring wood. The wood surfaces are planed flat.

Figure 2:
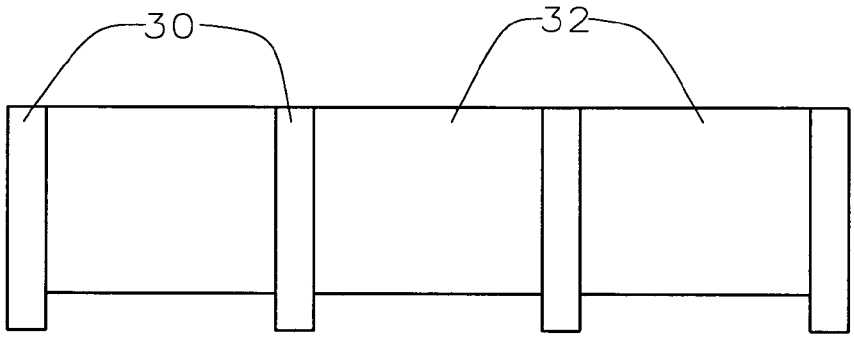
FIGS. 2-5 schematically represent cross-sections of a piece of tone wood of the present invention after various types of selective adjustment.

Next, the summer growth is removed selectively. FIG. 2 illustrates selective removal of the summer growth by etching chemicals. The top surface is left untouched. The corners of the winter growth may be slightly abraded by the mechanical rubbing action. Dotted lines 33 in FIG. 1 illustrate weakening of the summer growth below the dotted lines in an alternative to removing the summer growth.

Figure 3:
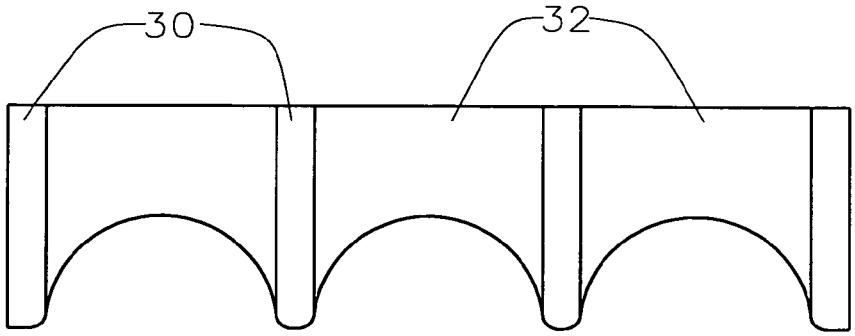

FIG. 3 illustrates a typical profile after sandblasting. The summer growth 32 erodes faster than the winter reeds 30. The differential rates limit the attainable stiffness ratio.

Figure 4:
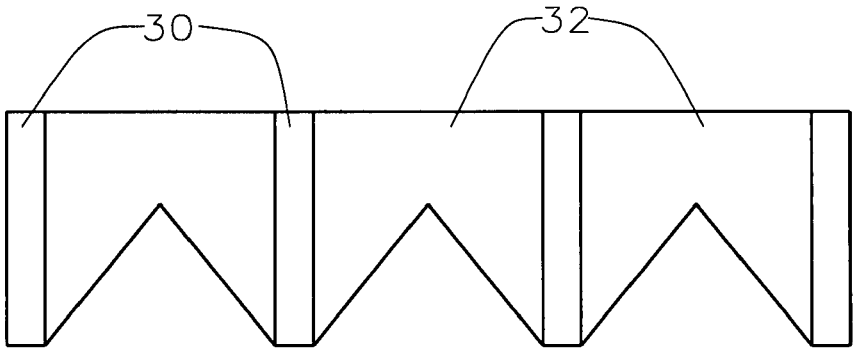

FIG. 4 illustrates the structure of FIG. 1 after mechanical grooving with a V-shaped riffling tool. In this method, no abrasion of the winter growth occurs. The riffle is effectively self-guided between the winter rails 30.

Figure 5:
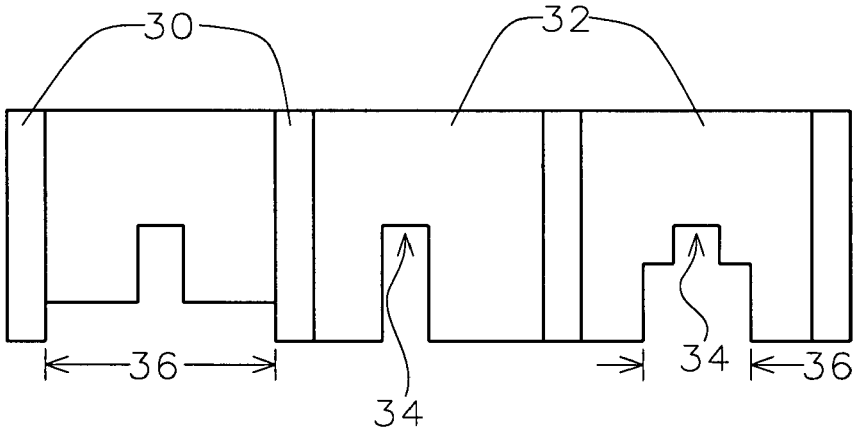

FIG. 5 is a conceptual structure that allows independent mass and stiffness modifications. Mass is controlled by choosing the starting thickness of the wood and by selectively eroding summer growth. The shape and depth of the groove can be varied to accomplish less stiffness by a deeper cut and less mass by a wider one or a combination of both. A deeper groove 34 controls the stiffness while a wider groove 36 controls the mass.

In one embodiment of the invention, material is not removed from a center strip of the tone wood so that this section will remain strong enough to carry the load of the tension of the strings. This also reinforces the action of the bass bar.

Damping is important in musical instruments. It determines the acoustical properties that we have come to recognize as characteristics of a given family of instruments. Internal friction, resisting bending, dissipates energy and reduces the acoustical output over time. This is determined by the intrinsic properties of wood. Cross-grain damping is reduced when the pulp is thinned. In a chemically treated surface, the cellular structure is weakened and does not contribute to stiffness but the residual damaged material will contribute to damping. Damping in a grooved plate can be controlled independent of stiffness by selectively coating or backfilling the grooves left by etching or riffling with damping material. Damping materials can be selected and/or modified to have any desirable properties. This way, stiffness, mass and damping can be modified relatively independently.

For example, varnish is a coating designed to protect a surface from mechanical or environmental damage. Varnish is an isotropic material; that is, it has no directionality. When applied to a wooden surface, varnish increases stiffness in all directions equally, thus reducing the longitudinal to cross-grain stiffness ratio by a small amount. Applying varnish or similar coatings to the inside of a treated spruce surface will have the same protective effect and can be used to reduce the stiffness ratio, thus reversing the effects of grooving. By adjusting the amounts of grooving and varnish applied to the tone wood, the stiffness and damping can be tailored to the desired degree.

Backfilling can be accomplished in addition to, or instead of, coating by depositing, for example, light, resilient coatings such as foam rubber in the grooves left after removing summer growth.

The final desirable structure of the tone wood results in the change of the ratio of longitudinal to cross-grain or trans-grain stiffness. Changes in mass and damping can be achieved by the addition of selective material either into the grooves or as coatings of the inside surface.

The key feature of the present invention is the selective weakening of the summer growth in tone wood, preferably spruce, without affecting the hard winter growth. The same effect may be produced by depositing narrow periodically spaced strips of material, such as carbon fiber, along the long axis of a slab of spruce or another substrate. The spaces between the strips will produce a weaker bending stiffness. Proper choice of material and dimensions can produce similar acoustical properties to those of wood. For example, a thin wood veneer or a plastic sheet may be used as a substrate and carbon fiber or wood or light metal strips may be deposited as strips to emulate the winter reeds of tone wood.

EXPERIMENTAL RESULTS

A flat, rectangular piece of spruce, 4.0 mm thick, measuring 252.5 mm along the grain and 91.5 mm across the grain was cut. Its mass was 43.9 grams. The stiffness along and across grain was measured by clamping the piece along an edge, applying a load at the edge away from the clamp and recording the resulting deflection. When clamped in the holder, the effective bending length of the plate was 228 mm and the effective bending width was 85.6 mm. The piece was then turned over and the deflection in the opposite direction was measured to determine any non-symmetric effects.

After the starting data had been recorded, the plate was etched on one side with a commercial two-part chemical system that is used for cleaning teak decks on boats. A soft wire brush helped to remove pulp efficiently. When a noticeable amount of material had been removed, the process was stopped with the second solution of the two-chemical system. A strong base does the etching and a weak acid stops the reaction.

After washing the plate in water, a hairdryer was used to dry it. The drying process was stopped when the plate did not lose any more weight. All measurements were repeated and recorded.

In the table of deflection measurements (Table 1) the two measurement conditions are labeled "top up" and "top down", where "top" is the unetched side. The column marked 'deflection' gives the measured displacement in millimeters at the bending length and width of 228 mm and 85.6 mm respectively. The 'normalized to square' column shows calculated values for deflections of a square plate of 85.6 by 85.6 mm. The 'spring constant' column calculates the proportionality constant (k) of the plate between load and displacement assuming a linear relationship. Column 'avg. k' shows the average k (spring constant) for 'top up' and 'top down' measurements. The stiffness change can be seen in the 'ratio' column; it displays the change in the longitudinal to transverse stiffness. The last column 'percent change' gives the percent change in the ratio caused by etching and riffling of the top plate. The riffling process was performed in the second step, described below.

TABLE 1

DEFLECTION MEASUREMENTS OF SPRUCE PLATE

| Load g | Direction | Deflection mm | Normalized to square | Spring const. k (g/mm) | Avg. k | Ratio k(l)/k(w) | Percent Change |
|---|---|---|---|---|---|---|---|
| | Long Axis | | | | | | |
| 218 | Top up | 1.37 | 0.28 | 666.7 | 717.9 | 12.6 | 0.00 |
| 318 | | 2.11 | 0.43 | | | | |
| 218 | Top down | 1.22 | 0.25 | 769.2 | | | |
| 318 | | 1.83 | 0.33 | | | | |
| | Long Axis | | | | | | |
| 218 | Top up | 1.46 | 0.30 | 714.3 | 714.3 | 15.06 | 19.54 |
| 318 | | 2.15 | 0.44 | | | | |
| 218 | Top down | 1.58 | 0.33 | 714.3 | | | |
| 318 | | 2.30 | 0.47 | | | | |
| | Long Axis | | | | | | |
| 218 | Top up | 1.68 | 0.35 | 666.7 | 645.8 | 16.75 | 32.93 |
| 318 | | 2.44 | 0.50 | | | | |
| 218 | Top down | 1.60 | 0.33 | 625.0 | | | |
| 318 | | 2.40 | 0.49 | | | | |
| | Wide Axis | | | | | | |
| 218 | Top up | 1.33 | 3.54 | 57.1 | 57.0 | | |
| 318 | | 1.99 | 5.29 | | | | |
| 218 | Top down | 1.00 | 2.66 | 56.8 | | | |
| 318 | | 1.66 | 4.42 | | | | |
| | Wide Axis | | | | | | |
| 218 | Top up | 1.70 | 4.52 | 50.0 | 47.4 | | |
| 318 | | 2.45 | 6.52 | | | | |
| 218 | Top down | 1.77 | 4.71 | 44.8 | | | |
| 318 | | 2.61 | 6.94 | | | | |
| | Wide Axis | | | | | | |
| 218 | Top up | 1.79 | 4.76 | 34.0 | 38.6 | | |
| 318 | | 2.89 | 7.7 | | | | |
| 218 | Top down | 2.07 | 5.51 | 43.1 | | | |
| 318 | | 2.94 | 7.83 | | | | |

T = 0 Initial conditions

T = 1 After etching

T = 2 After riffling

Effective bending dimensions: length = 228 mm, width = 85.6 mm, thickness = 4 mm.

Normalized dimensions: length = width = 85.6 mm, thickness = 4 mm.

The top of a commercial violin was opened and etched uniformly, removing a total of approximately 2 grams of soft wood. The area of the sound post was protected to maintain a flat surface for good sound post contact. After washing the inside with water and drying until a stable weight had been reached, the top was glued back and the instrument's spectrum was measured. The resulting changes in mode 2 and mode 5 are shown in Table 2 (Post-etch).

TABLE 2

| Process Step | Plate weight (g) | Mode 2 Frequency (Hz) | Mode 5 Frequency (Hz) | Comment |
|---|---|---|---|---|
| Initial condition | 81.9 | 173 | 402 | Reeds at 90 degrees |

TABLE 2-continued

| Process Step | Plate weight (g) | Mode 2 Frequency (Hz) | Mode 5 Frequency (Hz) | Comment |
|---|---|---|---|---|
| Post-etch | 79.8 | 162 | 377 | |
| Post-grooving | 79.6 | 149 | 330 | V-Groove |

The instrument was later played by a professional player in a large concert hall. The player stated that it was louder and significantly faster in response and the tone had become very interesting. Later, the plate response was measured and then additional wood was removed. This time a riffle rasp with a V-shaped cutting surface was used to cut V-grooves between the hard winter reed lines to further weaken the cross stiffness of the plate. Material was removed from the wings of the plate, leaving a center strip of about 2 inches untouched. The removal was done in this manner to leave the stiffer center strip strong enough to withstand the pressure from the neck foot against the belly. It is interesting to note that the rasp, once engaged between two reeds, was guided by the harder edges and followed the grain lines. The time it took to do the entire top was less than 30 minutes. Again the violin was measured. (See Table 2 for Post-grooving data). It was again played by a professional violinist in a concert hall. He found the instrument easy to play and very responsive. The tone was uniform over the entire range and interesting.

Figure 6:
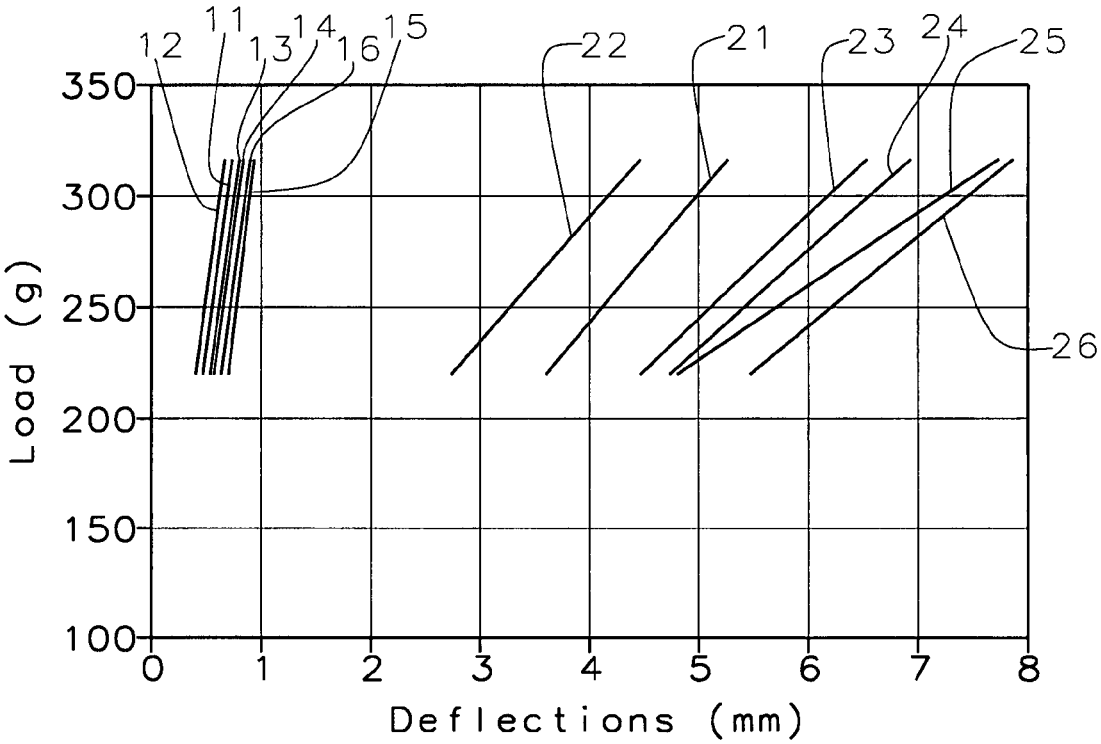
FIG. 6 graphically represents deflection vs. load of a piece of tone wood.

Visual observation of the surface of the plate after etching shows the preferential removal of the pulp of the wood. It also shows that some of the reeds have been slightly abraded by either the chemical etchant or the mechanical rubbing during the etching process. The riffling of the grooves leaves clearly defined ridges and valleys. Sandblasting has been tried but it removes both pulp and reeds, although at different rates. While some improvement may be obtained, the removal of the reeds limits the usefulness of this technique. The first deflection measurements showed consistent differences between the flexing of the plate in the 'top-up' vs. 'top-down' modes, for the initial and post-etch measurements. It is speculated that this is specific to the direction of the plate cut, or related to the reed angle of the quarter-sawn slab (about 75 degrees). For post-etched surfaces, it may be due to effects produced by the one-sided etching process. FIG. 6 shows the gradual change in stiffness for longitudinal and cross grain. The data of the rectangular plate were normalized to a square, measuring 85.6×85.6 mm. Deflection vs. load is shown graphically in FIG. 1 For the long axis, T=0 top up is shown by line 11, T=0 top down is shown by line 12, T=1 top up is shown by line 13, T=1 top down is shown by line 14, T=2 top up is shown by line 15, and T=2 top down is shown by line 16. For the wide axis, T=0 top up is shown by line 21, T=0 top down is shown by line 22, T=1 top up is shown by line 23, T=1 top down is shown by line 24, T=2 top up is shown by line 25, and T=2 top down is shown by line 26.

In this graph, it is easy to visualize the changing ratio of the bending stiffness. The decreasing transverse stiffness raised the ratio by 19.5% after the first etching step and by 33% after the final mechanical grooving of the plate. This is a major modification, probably in excess of naturally occurring variations in spruce.

The results of this experiment demonstrate that the basic longitudinal to transverse stiffness ratio can be changed by selectively removing summer growth between the reeds of spruce plates. This allows a maker to tailor the flexibility of soundboards of musical instruments. This allows for lower grade wood to be used to make good instruments and to make changes to existing instruments to improve their sound.

One may speculate that the phenomenon described, that the disintegration of soft pulp results in an improved tone of an instrument, relates to the superior sound of many old instruments. The flexibility of a beam or a plate is greatly influenced by the surface layers. While the outer surfaces of all violins are protected by ground layers and varnish, the inside is not. It is known by restorers of instruments that the surface layer of spruce on the inside of an old instrument often has the consistency of powder. It can be surmised that this layer no longer supports stiffness in either direction. It can be thought of as a passive remnant, perhaps contributing to damping of the wood. It is possible that a treatment of the inside surface of the top plate deteriorated the cellular structure of a thin layer to the point of eliminating its mechanical contributions to the plate other than damping. The suggestion is that it is similar to the etched structure described in this article and that it has weakened the cross-grain stiffness to produce the kind of sound that we expect from the famous Cremonese instruments, such as those made by Stradivarius.

Figure 7:
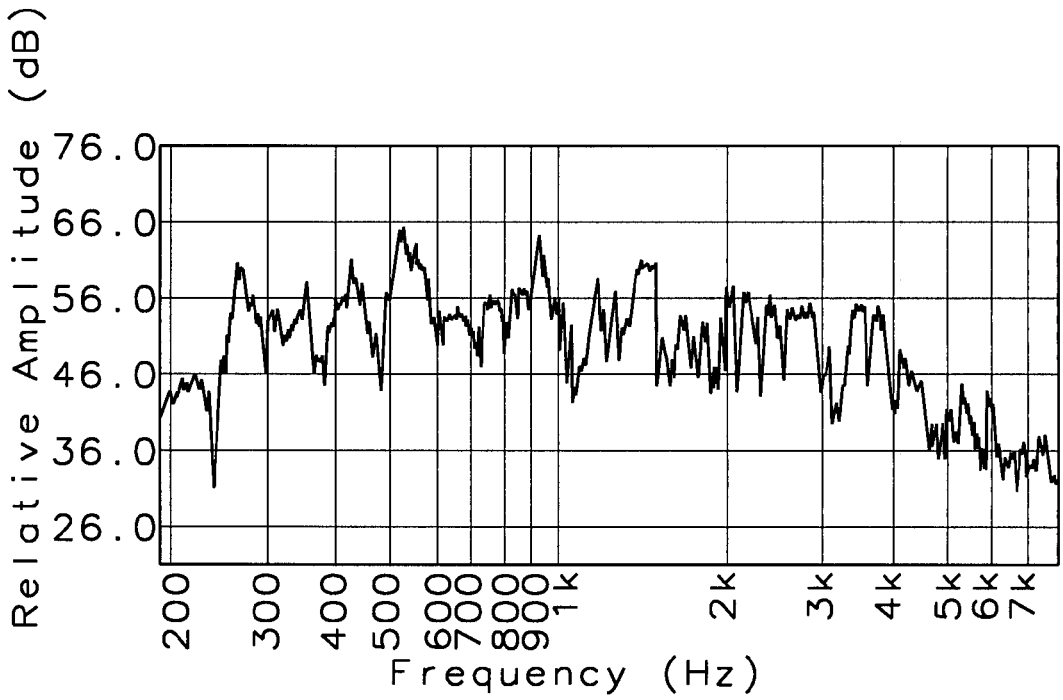
FIGS. 7-12 graphically represent frequency vs. amplitude data of a violin made using the process of the present invention.
Figure 8:
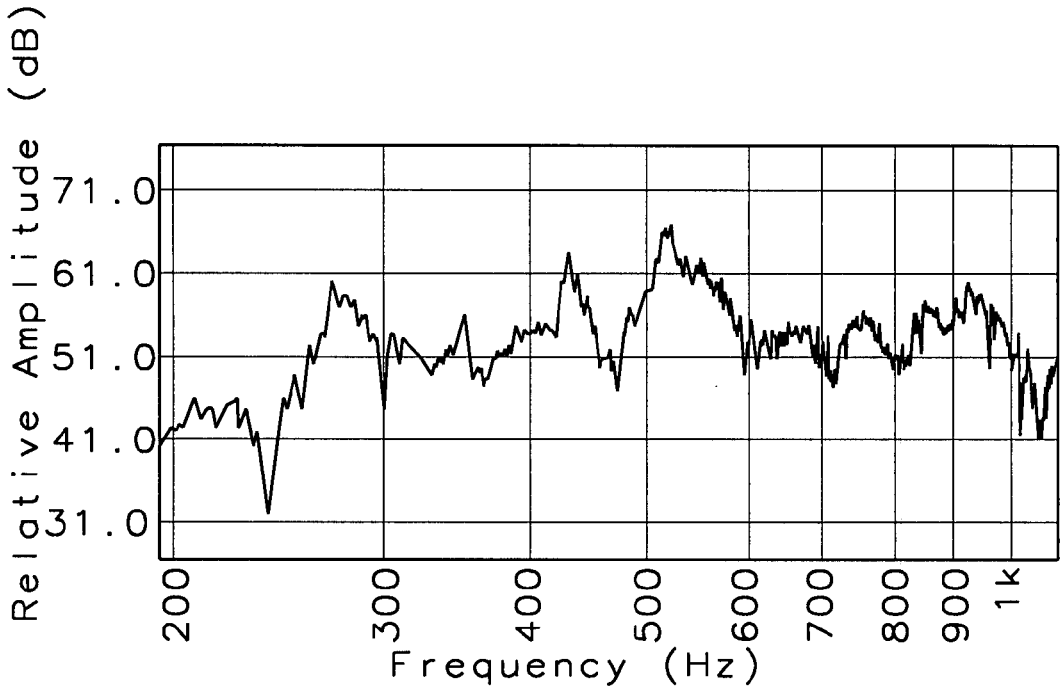

FIGS. 7-12 graphically illustrate the violin's spectral response. FIG. 7 illustrates the spectrum of a fully-assembled violin after riffling (as shown in FIG. 5). FIG. 8 expands the left-hand side of the spectrum of FIG. 7.

Figure 9:
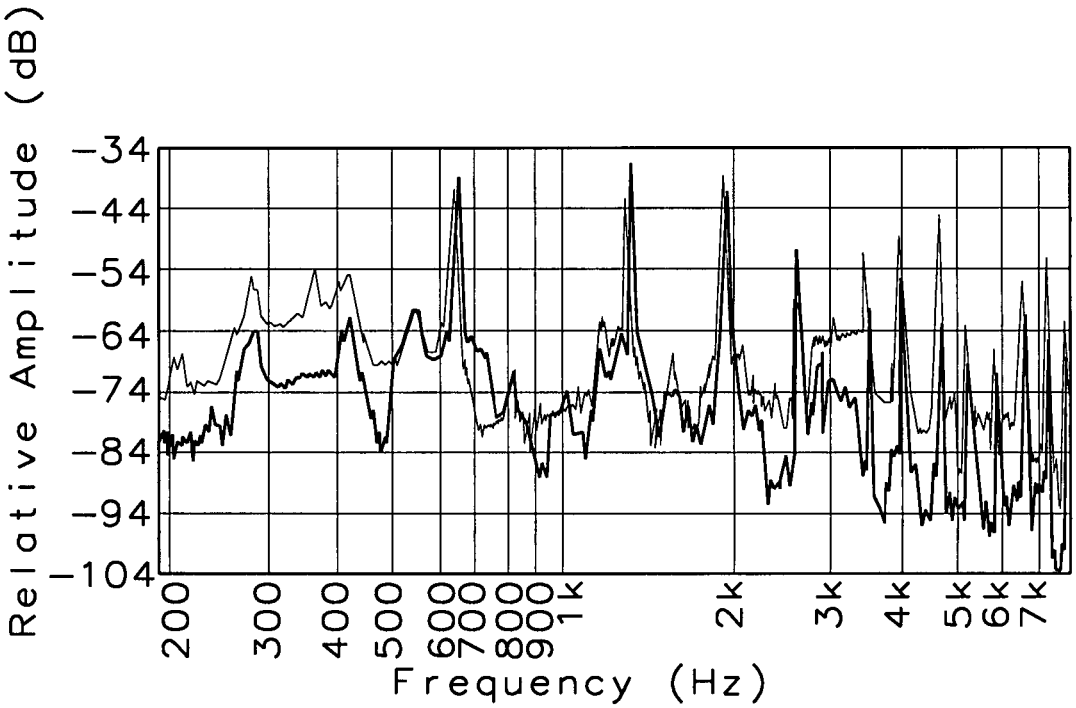
Figure 10:
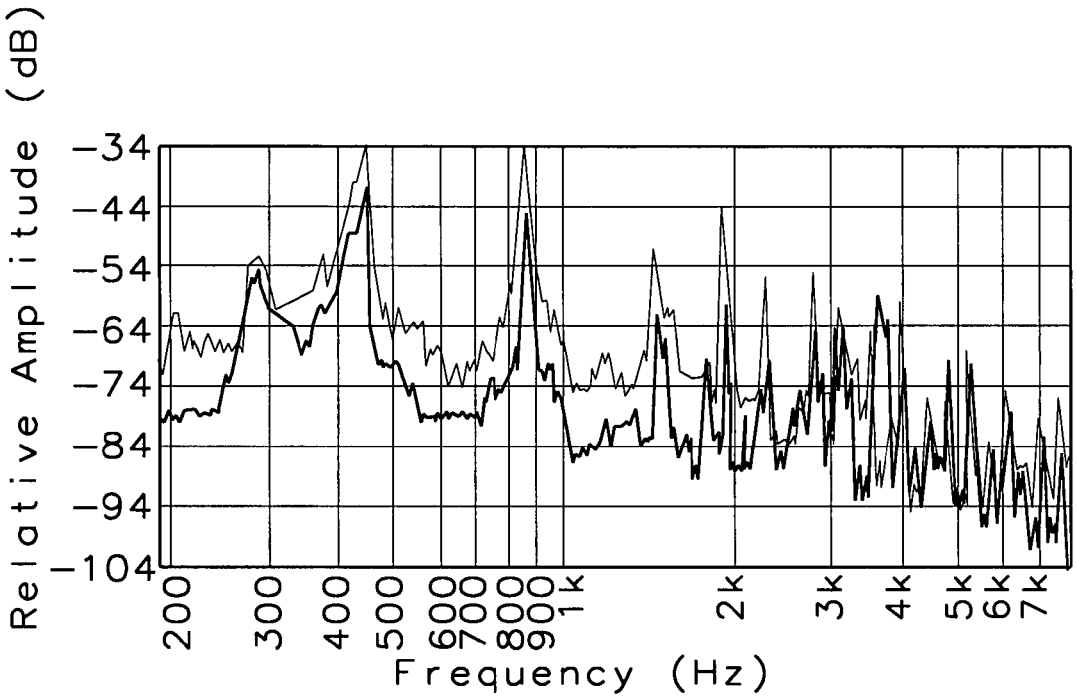
Figure 11:
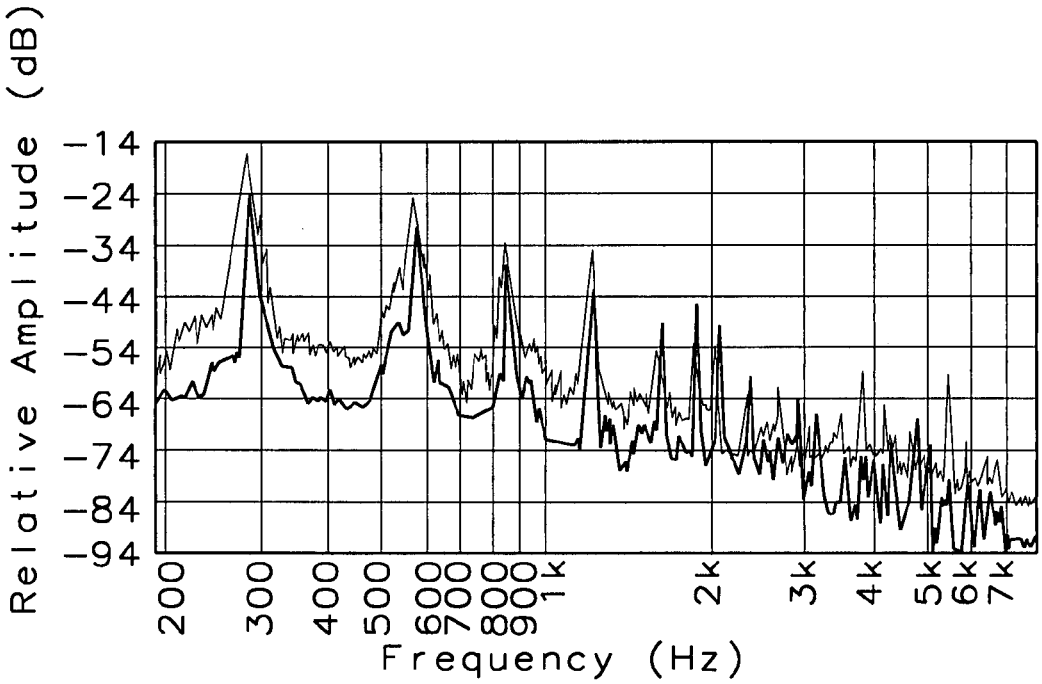
Figure 12:
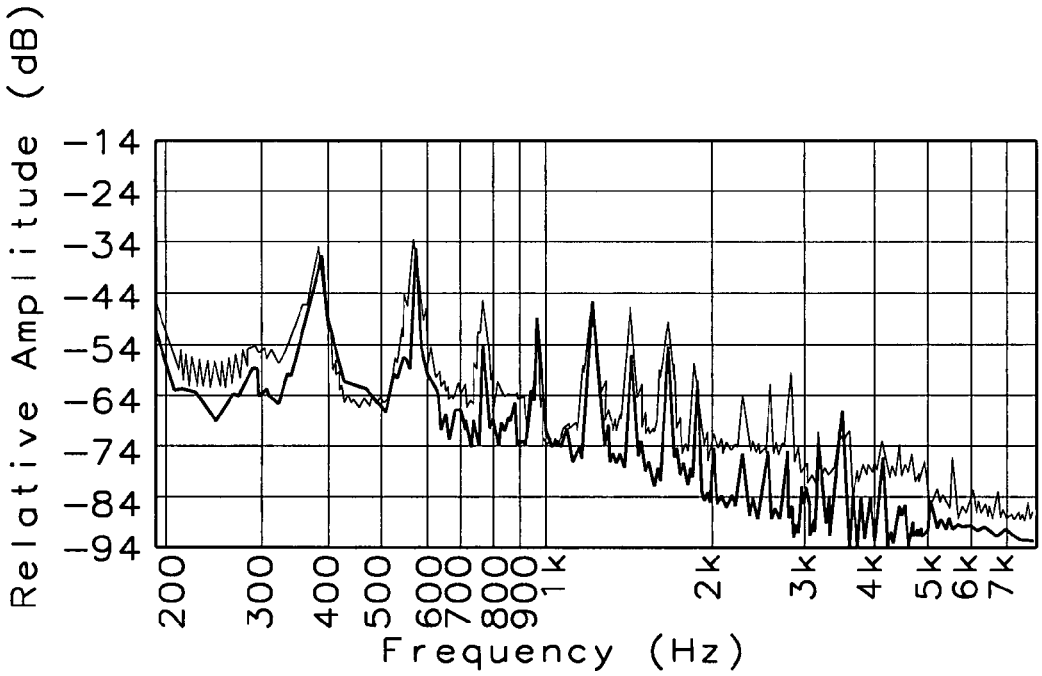

FIG. 9 illustrates the spectrum of the E string before riffling (thicker line) and after riffling (thinner line). Similarly, FIGS. 10-12 illustrate the spectrum of the A, D, and G strings, respectively, before riffling (thicker line) and after riffling (thinner line).

These graphs show that the tone wood of the present invention results in a quicker response and more power. These "after" spectral measurements are more similar to "old Italian" violins.

CONCLUSION

The present invention provides a method for tailoring critical properties of wood to achieve improved volume and tonal quality in stringed musical instruments and the wood or other substrate resulting from this process. The longitudinal to cross-grain stiffness ratio and the acoustical mass of tone wood are adjusted to improve volume and quality of tonal output. These properties are adjusted by selectively removing a portion of summer growth of the wood to reduce cross-grain stiffness while retaining the winter growth of the wood for longitudinal stiffness. Damping materials can modify the effects of the summer growth removal and can also add mass. By adjusting the amounts of grooving of the summer growth and damping materials applied to the tone wood, the stiffness and damping can be tailored to the desired degree.

The process and structure of the present invention can be practically applied to violins and other stringed instruments. Furthermore, the process of the invention is an ideal structure to isolate variables in a laboratory setting.

While the invention has been particularly shown and described with reference to the preferred embodiments thereof, it will be understood by those skilled in the art that various changes in form and details may be made without departing from the spirit and scope of the invention.

What is claimed is:

1. A soundboard for use in stringed instruments comprising:

a wood substrate having summer growth areas of said wood between winter growth ridges spaced periodically along the long axis of said substrate;

a chemically treated surface having a layer of damaged residual cellular structure in said summer growth that does not contribute to stiffness; and in view of said cellular damage to said summer growth, the longitudinal to cross-grain stiffness ratio of said substrate is increased over an untreated sound board.

2. The soundboard of claim 1 wherein said wood comprises spruce.

3. The soundboard of claim 1 wherein said summer growth portions are not damaged within a center strip of said spruce along said long axis.

4. The soundboard of claim 1 wherein said damaged summer growth areas provide damping.

5. A soundboard for use in stringed instruments comprising:

a spruce slab having summer growth areas of said spruce between winter growth ridges spaced periodically along the long axis of said substrate;

a chemically treated surface having a layer of damaged residual cellular structure in said summer growth that does not contribute to stiffness wherein grooves are formed in said damaged summer growth and wherein said winter growth is raised above said summer growth; and in view of said cellular damage to portions of said summer growth, the longitudinal to cross-grain stiffness ratio of said substrate is increased over an untreated sound board.

6. The soundboard of claim 5 wherein said summer growth is not damaged within a center strip of said spruce slab along said long axis.

7. The soundboard of claim 5 wherein a shape and depth of said grooves is varied to accomplish less stiffness by a deeper groove or less mass by a wider groove or a combination of both.

8. The soundboard of claim 5 further comprising a coating of damping materials on said spruce slab or backfilling said grooves with damping materials.

9. The soundboard of claim 8 wherein said damping materials comprise foam rubber or a filling material other than foam rubber.

10. A method of tailoring the longitudinal to cross-grain stiffness in wooden sound boards, wherein a wood substrate comprises softer summer growth areas and harder winter growth areas in alternate layers spaced periodically along the long axis of said wood substrate, the method comprising:

applying a strong basic solution to said wood substrate that weakens said softer summer growth areas;

applying a weak acidic solution to stop reaction of said strong basic solution;

thereafter washing with water to clean said wood substrate; and thereafter drying said wood substrate until the mass of said substrate does not reduce wherein said longitudinal to cross grain stiffness ratio is increased.

11. The method of claim 10 wherein said weakened said softer summer growth areas provide damping.

12. The method of claim 10 wherein said softer summer growth areas are not weakened within a center strip of said wood substrate along said long axis.

13. The method of claim 10 wherein said strong basic solution is an etching chemical.

14. The method according to claim 10 wherein said washing and drying said wood substrate results in grooves formed in said softer summer growth areas and further comprising applying damping materials comprising selectively coating said tone wood with said damping materials or backfilling said grooves with said damping materials.

15. The method according to claim 14 wherein said damping materials comprise varnish or a coating other than varnish or foam rubber or a filling material other than foam rubber.

16. The method according to claim 10 further comprising using a wire brush to remove weakened said softer summer growth areas prior to applying said weak acidic solution.

* * * * *